US005666030A

United States Patent [19]

Parson

[11] Patent Number: 5,666,030

[45] Date of Patent: Sep. 9, 1997

[54] MULTIPLE WINDOW GENERATION IN COMPUTER DISPLAY

[75] Inventor: Donald H. Parson, Liberty, S.C.

[73] Assignee: NCR Corporation, Dayton, Ohio

[21] Appl. No.: 277,682

[22] Filed: Jul. 20, 1994

[51] Int. Cl.[6] ..... G09G 3/10

[52] U.S. Cl. ..... 315/169.3; 345/23; 345/24

[58] Field of Search ..... 315/169.3; 364/518, 364/512, 521; 340/747, 750; 395/157, 158

[56] References Cited

U.S. PATENT DOCUMENTS

| | | | |
|---|---|---|---|
| 4,641,255 | 2/1987 | Hohmann . | |
| 4,642,790 | 2/1987 | Minshull et al. . | |
| 4,862,155 | 8/1989 | Dalyrymple et al. | 340/747 |
| 4,954,970 | 9/1990 | Walker et al. . | |
| 5,003,491 | 3/1991 | Heckt . | |
| 5,093,798 | 3/1992 | Kita . | |
| 5,099,331 | 3/1992 | Truong . | |
| 5,185,858 | 2/1993 | Emery et al. . | |

*Primary Examiner*—Frank G. Font
*Assistant Examiner*—Reginald A. Ratliff
*Attorney, Agent, or Firm*—Gregory A. Welte

[57] ABSTRACT

The invention concerns storage of data within a computer, from which a composite image may be generated on the computer's display. The data may include different types, which are normally incompatible, such as particular types of RGB data, and particular types of YUV data. As a specific example, the invention allows a user to view the image generated by an ordinary computer program, such as a word-processing program; which uses RGB data, together with a movie stored on video tape, which may use YUV data. The movie appears in a small window on the display.

6 Claims, 10 Drawing Sheets

FIG. 4B

| PIXEL / Y, U, V | 1 | 2 | 3 | 4 | 5 | |
|---|---|---|---|---|---|---|
| Y | Y1 | Y2 | Y3 | Y4 | Y5 | |
| U | U1 | $\frac{U1 + U3}{2}$ | U3 | $\frac{U3 + U5}{2}$ | U5 | |
| V | V1 | $\frac{V1 + V3}{2}$ | V3 | $\frac{V3 + V5}{2}$ | V5 | |
| BITS | 24 | 8 | 24 | 8 | 24 | |
| AVERAGE BITS / PIXEL | 16 | | 16 | | 16 | |

MULTIPLE WINDOW GENERATION IN COMPUTER DISPLAY

The invention concerns the generation of multiple images on a computer display. The images are based on data sources having different formats. For example, a word processing document can provide one image, generated in the usual manner. The other image can be generated from a video tape, which uses data having a different format. Both images appear on the same display.

BACKGROUND OF THE INVENTION

There are numerous types of video displays used in computers. This Background will discuss an exemplary, hypothetical display.

Electron Beams Sweep Screen

FIG. 1 illustrates a cathode ray tube (CRT), which generates a color image on its screen S. The CRT contains three electron guns, RED, GREEN, and BLUE. Each electron gun shoots a beam of electrons to the screen.

Scanning coils (not shown) cause the electron beams to sweep together, left-to-right, from point A in FIG. 2A to point B in FIG. 2B. Then, the scanning coils move the electron beams to point C in FIG. 2B, and repeat the left-to-right scan. The overall result is the raster scan shown in FIG. 2C.

Electron Beams Cause Phosphors to Emit Light

In FIG. 3, every line L, along which the electron beams scan, is composed of pixels, which are indicated by the dashed boxes. Each pixel contains a triplet of phosphors, labeled R, G, and B. The phosphors emit light when struck by the electron beams. The number of pixels is quite large. In 1993, a commonly used type of CRT contains 640 pixels in a line L, and 480 lines on the screen S. This type of display contains 307,200 pixels (ie, 640×480 pixels).

As the electron beams scan a line L, they spray each pixel in the line with electrons. However, the electron guns are focused so that each gun sprays a single phosphor in each pixel. That is:

The RED gun sprays the R phosphors (shown in FIG. 3), and no others. The R phosphors emit red light.

The GREEN gun sprays the G phosphors, and no others. The G phosphors emit green light.

The BLUE gun sprays the B phosphors, and no others. The B phosphors emit blue light.

The intensity of each electron beam determines the brightness of each phosphor. Together, the light-emitting phosphors in each pixel appear as a single dot of color. The particular color is determined by the relative brightnesses of the red, green, and blue phosphors.

Intensity of Electron Beams is Controlled

The intensity of each electron beam (and thus the brightness of the phosphor being sprayed) is controlled by an analog signal applied to the electron gun generating the beam. Typically, the analog signal ranges from 0 volts to 1.0 volt, in 0.001 volt increments. For example, an analog signal of zero volts causes no electrons to be present in the beam; an analog signal of 1.0 volts causes maximum electron intensity in the beam.

A VIDEO CONTROLLER, shown in FIG. 4, applies the analog signals to the electron guns. Because each gun receives three analog signals, three sequences of analog signals are applied to the electron guns in the course of generating one image on the screen S. Restated, the overall image on the screen S is determined by the analog signal sequences.

The three sequences of analog signals are generated based on data contained in a frame buffer (also called a video RAM). The frame buffer contains one memory location for each pixel. The memory location contains the data for the three analog signals for the electron guns.

However, this data is stored in digital format, as ONEs and ZEROs, and not in analog format. The data must be converted to the analog format required by the electron guns. The conversion is performed in a device called a RAM DAC:Random Access Memory for Digital-to-Analog Conversion.

The digital word for each pixel is fed to to the RAM DAC. The RAM DAC acts as a lookup table which produces a predetermined combination of three analog voltages for each digital word. That is, the single digital word at each memory location in the frame buffer contains information from which three analog voltages are derived. A hypothetical example, using arbitrary values, is the following:

RAM DAC Lookup Table

| Digital Word (From Frame Buffer) | RAM DAC Output RED Gun | GREEN Gun | BLUE Gun |
|---|---|---|---|
| 0000 0000 | 0 mV | 0 mV | 1 mV |
| 0000 0001 | 0 mV | 0 mV | 5 mV |
| ********* | | | |
| 0000 0111 | 0 mV | 1 mV | 0 mV |
| 0000 1000 | 0 mV | 5 mV | 0 mV |
| ********* | | | |
| 0010 0000 | 1 m | 0 mV | 0 mV |
| 0010 0001 | 5 mV | 0 mV | 0 mV |
| ********* | | | |
| 1000 0000 | 1 mV | 1 mV | 1 mV |
| 1000 0001 | 5 mV | 5 mV | 5 mV |

In this example, a digital word of 0000 0000, obtained from the frame buffer, causes a very faint pure blue color of the pixel involved. A digital word of 0000 0111 causes a faint, pure green color, and so on.

It should be observed that this RAM DAC approach does not allow every possible analog voltage combination to be utilized. That is, 1,000 possible analog voltages for each of three electron guns provides 1 billion possible combinations of red, green, and blue. Because the frame buffer contains words which are only eight bits wide, only 2**8, or 256, possible color combinations are possible, out of the total one billion, for a given RAM DAC.

Recapitulation

Therefore, to recapitulate, the sequence of events which occurs in generating a video image on the CRT screen S is the following. In FIG. 4A, for each pixel on the screen, a data word is read from the FRAME BUFFER. The data word is applied to the RAM DAC, which generates three analog voltages for the electron guns. The electron guns fire electron beams of the intensifies dictated by the analog signals, and then sweep to the next pixel, where a new word from the FRAME BUFFER creates three new analog signals, and so on.

System Described is "RGB" System

The data stored in the FRAME BUFFER in FIG. 4A, is often termed "RGB" data, because it translates directly into analog voltages for the Red, Green, and Blue electron guns. However, other types of digital video data are also in use. One example is the YUV format.

YUV Format

Simplified Description

In YUV format, the color of a pixel is determined by three pixel characteristics, namely, (a) color, (b) tint, and (c) intensity. (In the RGB system, the pixel color is determined instead by a combination of (a) red intensity, (b) green intensity, and (c) blue intensity.)

In the YUV system, three data words are used for a pair of pixels, as opposed to a single data word for each pixel in the RGB system. In the YUV system, based on the three data words, both pixels in the pair are given the same color and tint, but different intensities. The YUV format is clearly different from the RGB format.

YUV: Greater Detail

The YUV convention specifies the luminance (Y) and two color components (U and V) of the pixels. There are many formats available, such as 2:1:1, 4:1:1, 4:2:2, 4:4:4.

FIG. 4B illustrates the 4:2:2 format. For pixel 1, YUV data is specified as Y1, U1, and V1. For pixel 2, Y2 is specified, but the U and V values are interpolated from the U and V values of the adjacent pixels. That is, U2 is computed as (U1+U3)/2, and V2 is computed similarly. (In this case, the interpolation is the numerical average.)

As indicated, the odd-numbered pixels require 24 bits of storage space (eight bits for each of Y, U, and V). The even-numbered pixels require 8 bits of storage space (eight bits for Y, and nothing for U and V, because U and V are, in effect, stored elsewhere). The average storage space per pixel is 16 bits.

If the RGB format is also 16 bits per pixel, then this 4:2:2 format (of 16 bits per pixel) can co-exist with RGB data within a common frame buffer. However, if the RGB data is stored in a different format, then this co-existence may not be possible.

Further, if the YUV data is stored in a different format, such as 4:4:4, then this co-existence again may not be possible. In the 4:4:4 format, the interpolation shown in FIG. 4B is not undertaken, and each pixel carries full luminance (Y) and color (U,V) information. If each of Y, U, and V requires eight bits, then each pixel requires 24 bits, not 16 bits, as in 4:2:2 format.

If the RGB format being used also requires 24 bits per pixel, then co-existence with YUV data is possible. If not, then co-existence is not possible.

Therefore, it is clear that YUV data is not necessarily compatiible with RGB data. Compatibility issues will now be addressed.

Combining RGB and YUV Data is Desired

It is frequently desired to combine both YUV and RGB data on a single computer screen. For example, a user may wish to run a word processing program, which uses RGB data, and simultaneously watch a video tape, which is encoded in YUV format. The video tape can be displayed in an INSERT, as shown in FIG. 5.

To create the INSERT, the information represented by the video-YUV data is loaded into the memory locations within the frame buffer which correspond to the INSERT. However, as discussed above, the YUV data may be incompatible with the RGB data. If so, the YUV data must be first translated into RGB format, and then loaded into the frame buffer.

Loading YUV Data into FRAME BUFFER is not Favored

However, this translation-loading approach is not favored, because it requires a translation system, which adds cost. Further, the translated YUV data, when loaded into the FRAME BUFFER, displaces the original data.

The original data must be kept available, in case the the user eliminates the INSERT, thereby necessitating reconstruction of the original image which the INSERT displaced. Thus, under this translation-loading approach, another memory location must be provided to store the data representing the original image which the INSERT displaced.

Alternate Approaches

Another alternative will be explained by example. In FIG. 6, as the electron beams scan from A to B, the pixel data is read from the corresponding locations in the FRAME BUFFER in FIG. 4A, and translated into analog voltages by the RAM DAC, in the usual manner.

Then, as the electron beams scan from B to C, the pixel data is read from a data stream (not shown) providing YUV data. The YUV data is translated into RGB data, and then fed to the RAM DAC, which produces analog signals for the electron guns.

Then, as the electron beams scan from C to D, the pixel data is read again from the FRAME BUFFER.

The switching between the two data sources (the YUV stream and the FRAME BUFFER) can be accomplished in numerous different ways.

One way is to fill the entire field in the FRAME BUFFER, corresponding to the INSERT, with a specific word, such as 1111 1111, as shown in FIG. 7. As each data word is read from the FRAME BUFFER for each pixel, a detector examines the word.

If the word is 1111 1111, then the detector causes the system to ignore the 1111 1111 word and, instead, take data for the present pixel from the YUV source. If the word is other than 1111 1111, then the detector causes the system to use that very data word for the pixel.

One disadvantage of this approach is that the entire field in the frame buffer (corresponding to the INSERT) contains multiple copies of a single word, 1111 1111, instead of data for an image. The image data is lost, unless it is saved in another memory location. This saving requires an additional system.

Another approach devotes a single bit of each word in the FRAME BUFFER to the switching function. That is, a detector examines this single bit, which can be the most significant bit (MSB) in each word.

For example, if the MSB is ONE (which occurs for all words 1xxx xxxx, wherein x means either ONE or ZERO), then the DETECTOR causes the current pixel to receive its data from the FRAME BUFFER. If the MSB is ZERO (in 0xxx xxxx), then the DETECTOR causes the current pixel to receive its data from the ALTERNATE SOURCE.

One disadvantage of this approach is that only seven bits, instead of eight, carry color information. That is, each pixel now has only 128 possible colors (ie, 27). Thus, a trade-off has occurred: On the one hand, the data field in the FRAME BUFFER in FIG. 7, corresponding to the INSERT, no longer contains the word 1111 1111** at every location, and now contains image information. On the other hand, the image information in every memory location in the FRAME BUFFER has now been reduced by one bit. The color information for each pixel has been cut in half: from 256 bits to 128 bits.

OBJECTS OF THE INVENTION

An object of the invention is to provide an improved video system for computers.

A further object of the invention is to provide a system in computers for creating images on the display which are based on data sources of different formats.

SUMMARY OF THE INVENTION

In one form of the invention, a video frame buffer contains a data word for each pixel of a display. Each data word is nine bits long. Eight bits are used for color information for the pixels, and one bit is used to determine whether the associated eight bits are to be used for the display, or whether other data is used.

BRIEF DESCRIPTION OF THE DRAWINGS

FIG. 4B illustrates the 4:2:2 YUV format.

DETAILED DESCRIPTION OF THE INVENTION

Figure 1:
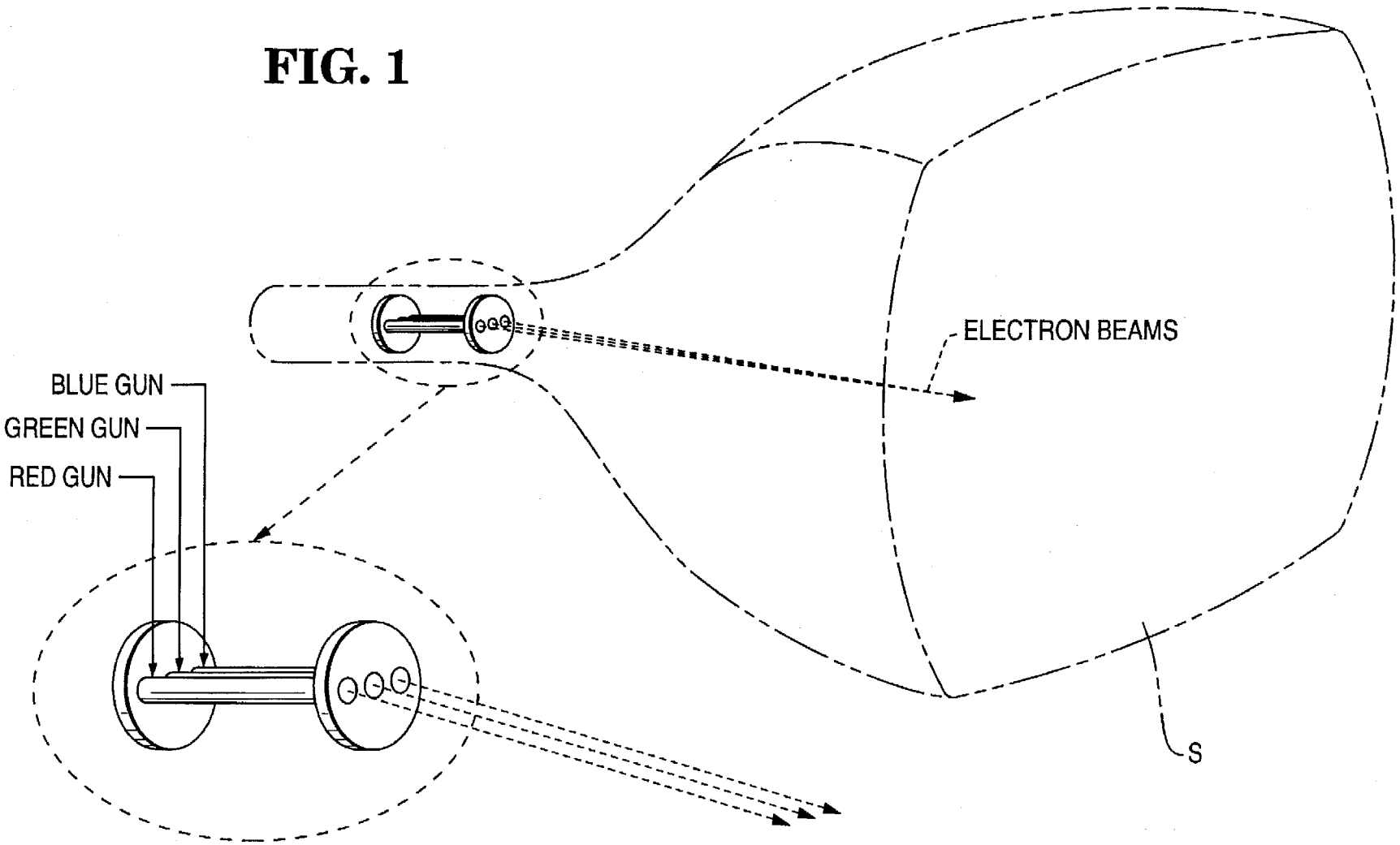
FIG. 1 illustrates a Cathode Ray Tube, CRT.
Figure 2A:
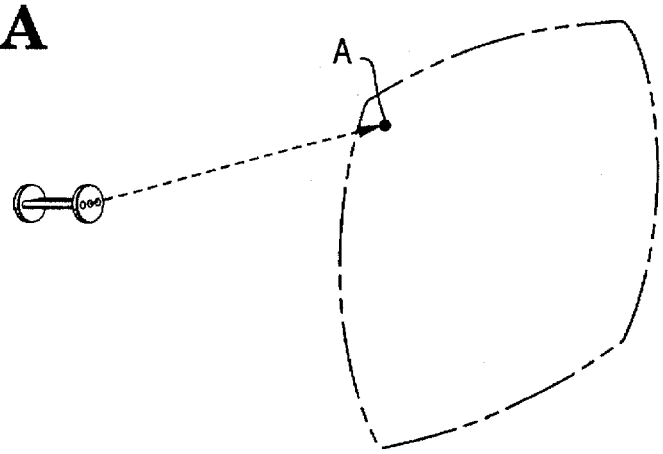
FIGS. 2A, 2B, and 2C illustrate scanning of the ELECTRON BEAMS of FIG. 1.
Figure 2B:
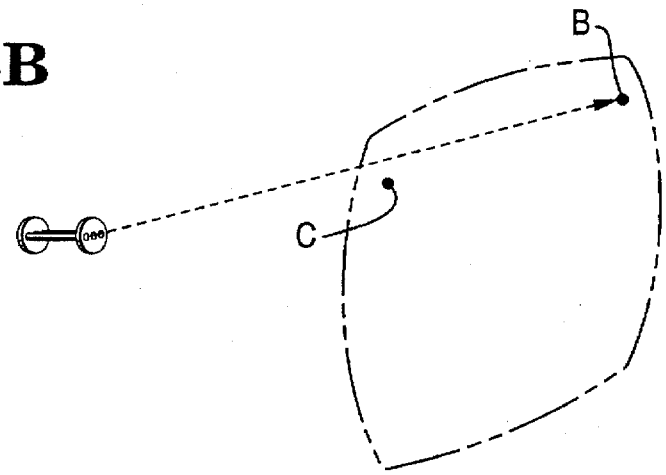
Figure 2C:
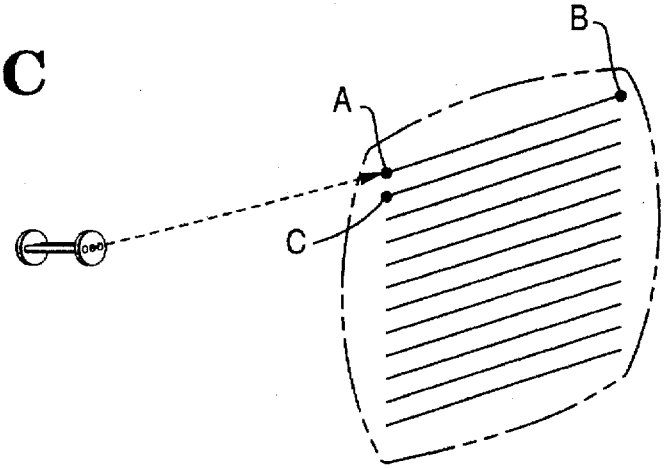
Figure 3:
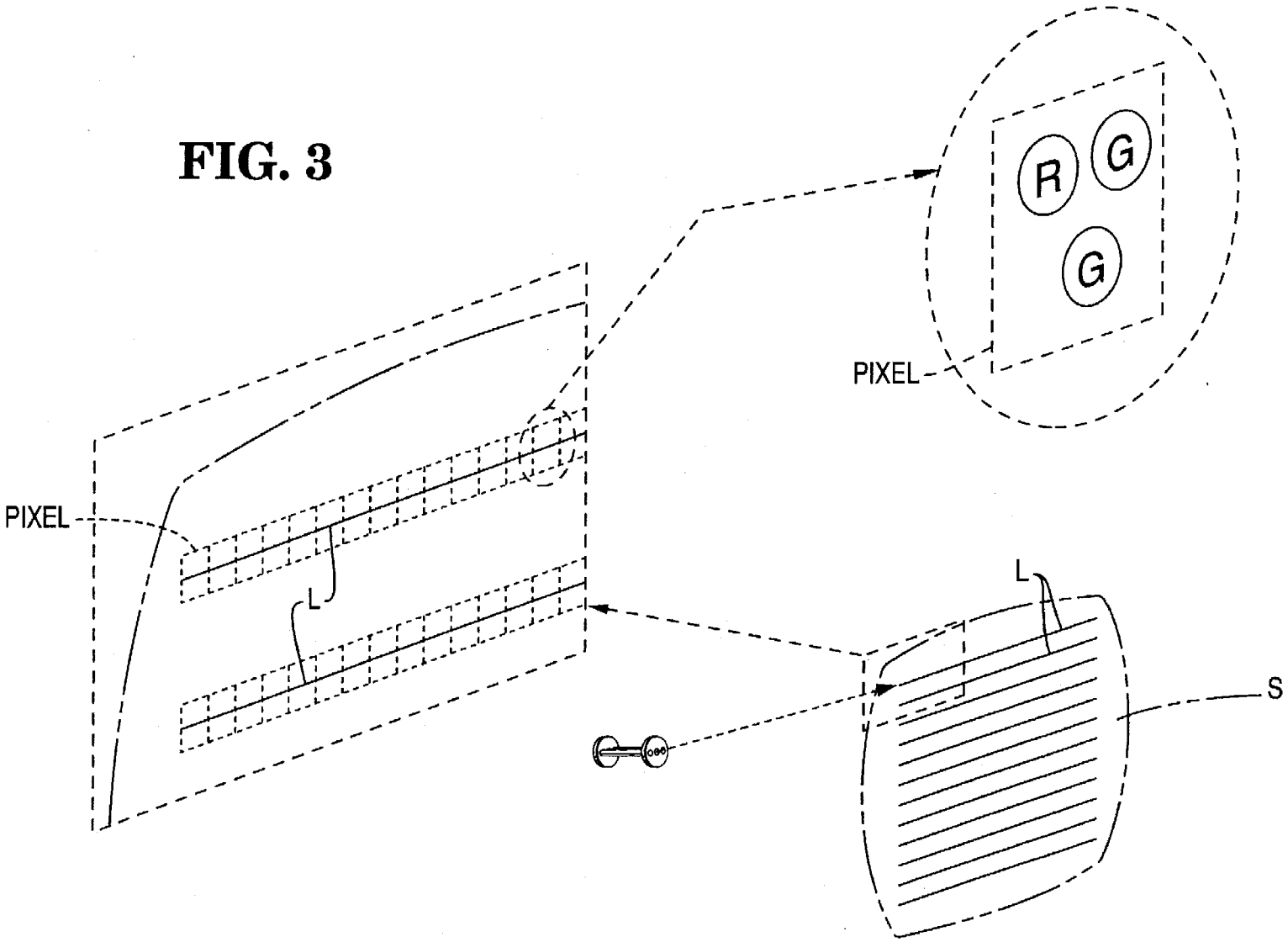
FIG. 3 illustrates how each line L of a scan contains individual pixels.
Figure 4:
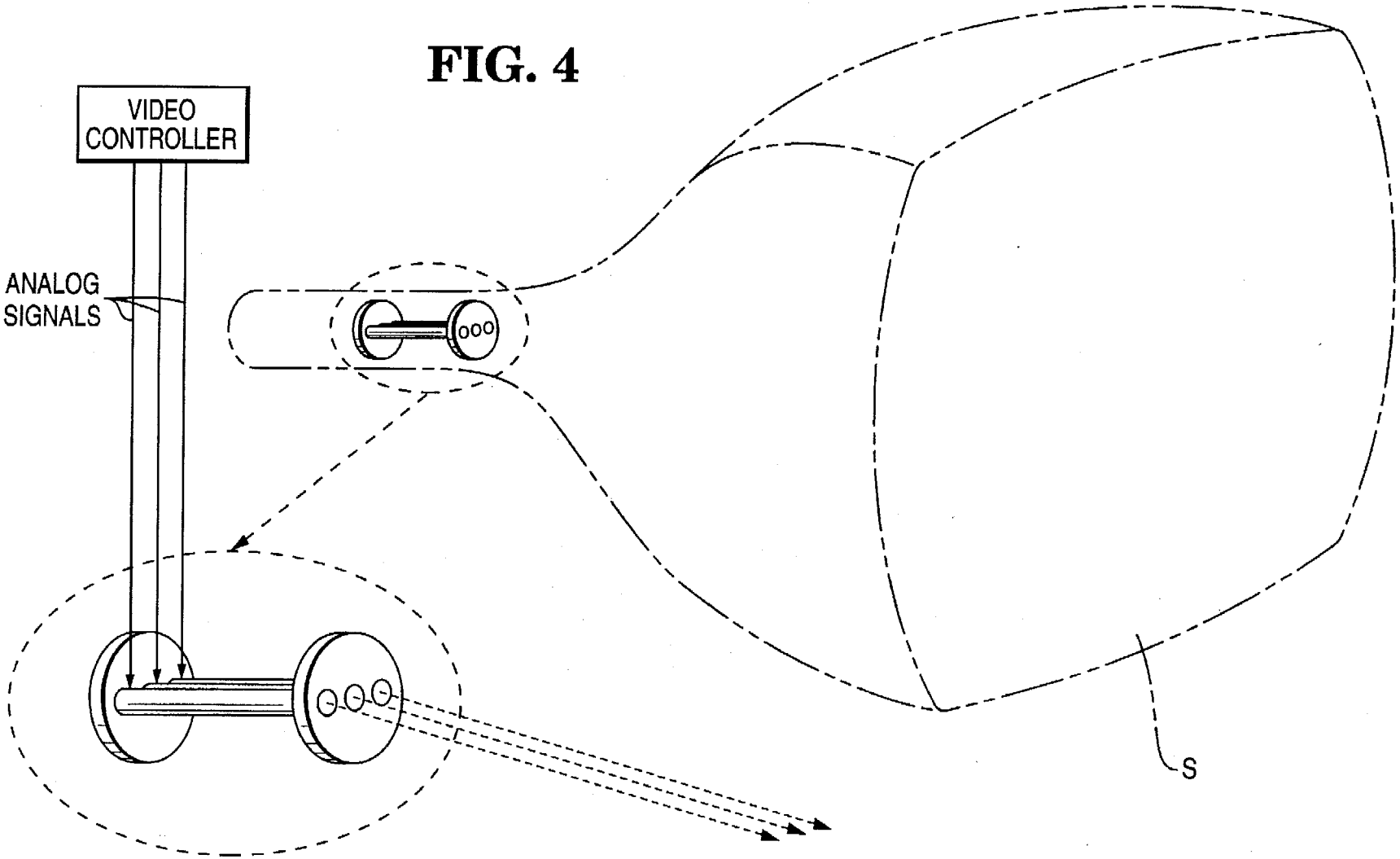
FIG. 4 illustrates how analog, not digital, signals are fed to the electron guns which generate the electron beams.
Figure 4A:
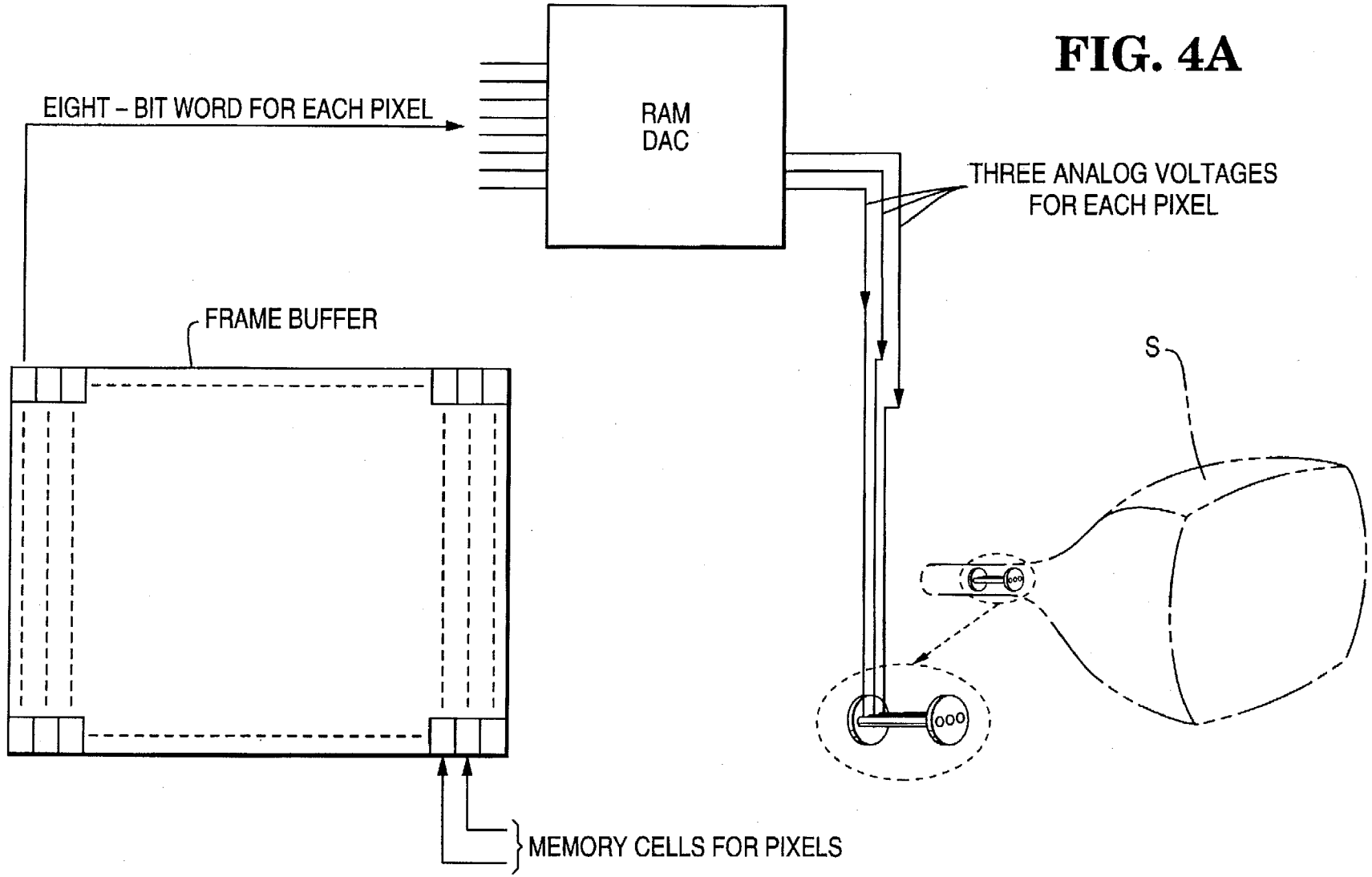
FIG. 4A illustrates how digital data words taken from a FRAME BUFFER are converted into ANALOG VOLTAGES by a RAM DAC.
Figure 5:
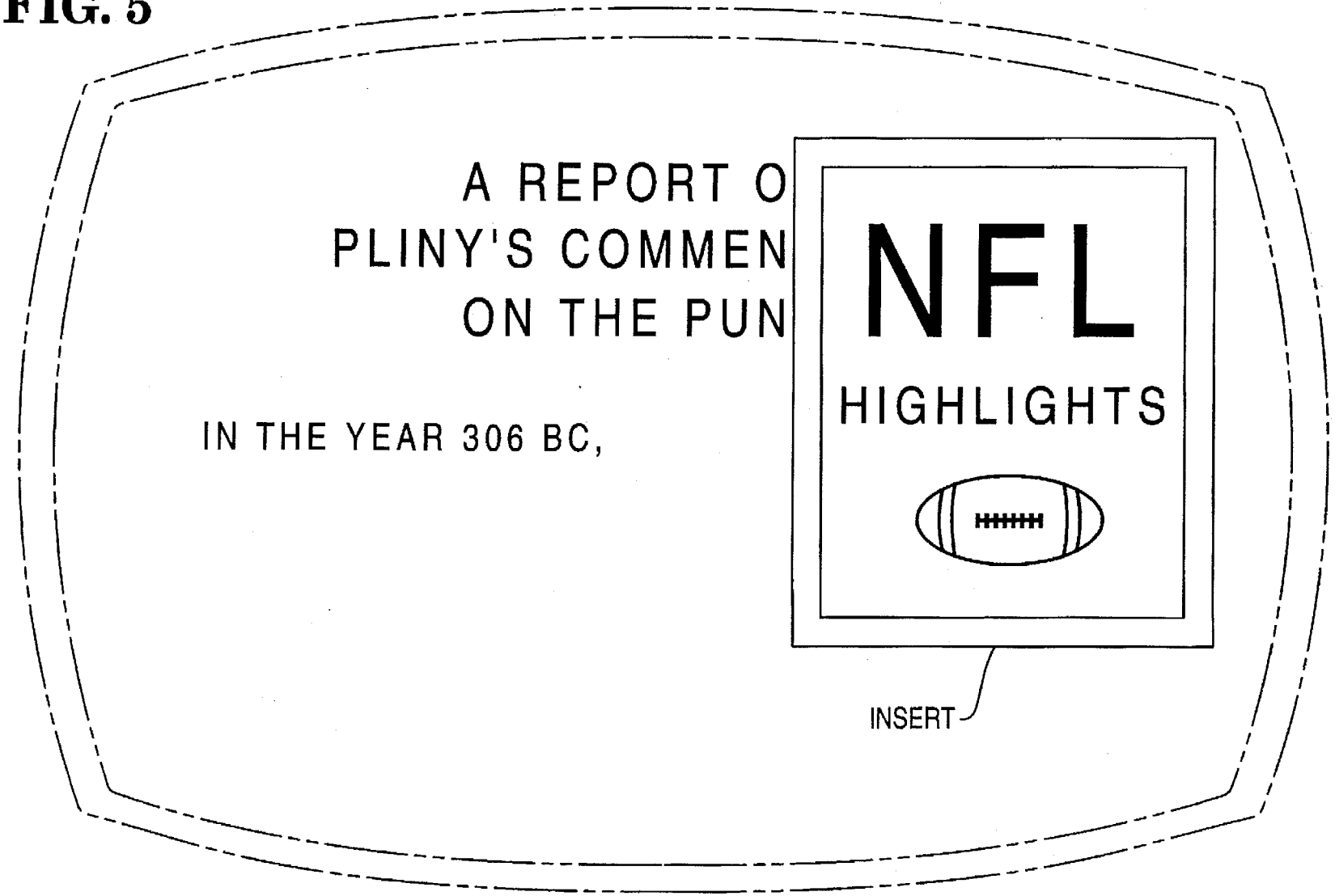
FIG. 5 illustrates an INSERT contained on a video display. Two different images, based on two different data sources, are shown.
Figure 6:
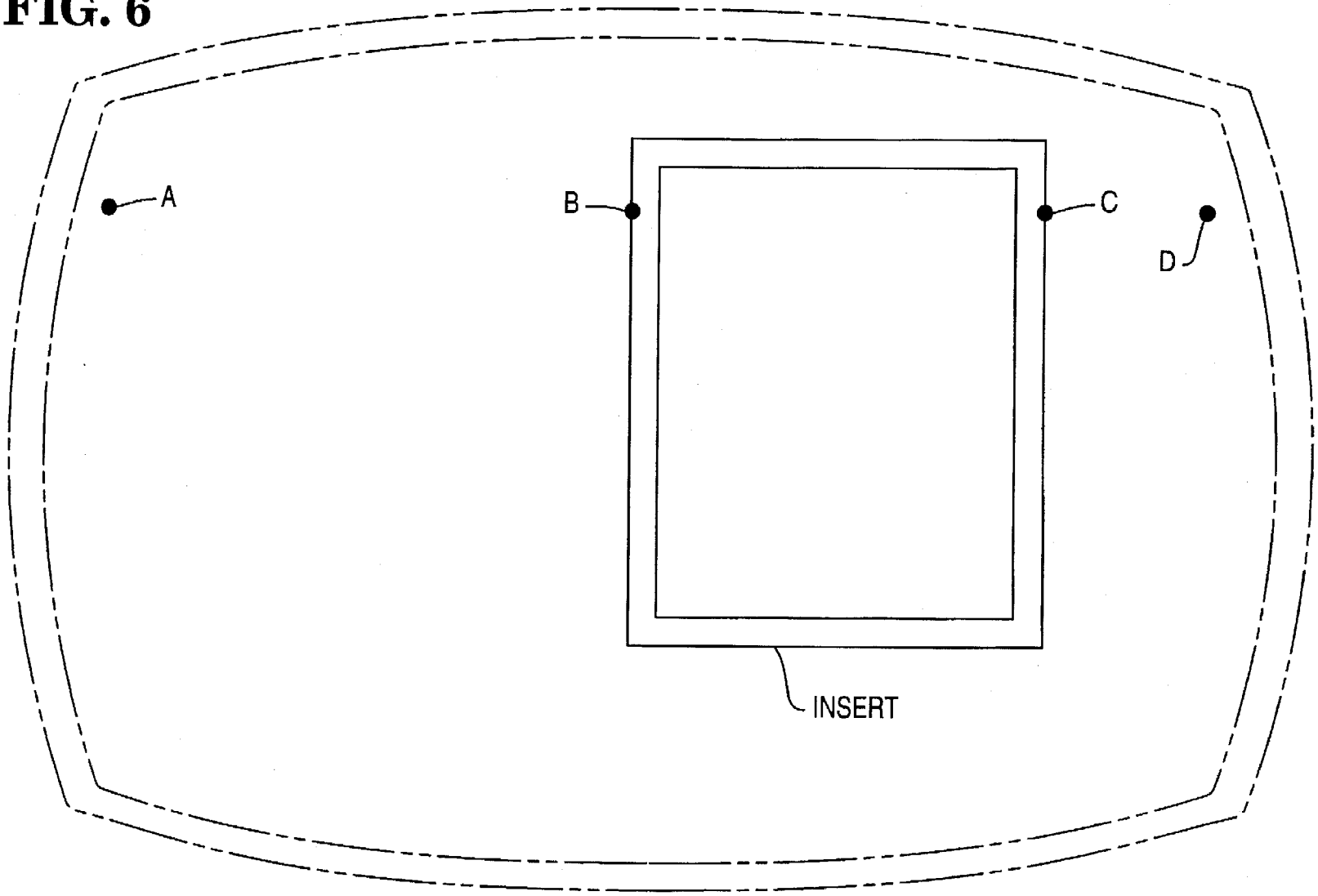
FIG. 6 illustrates three parts of a scan line (A–B, B–C, and C–D). Two parts are derived from a frame buffer, and the third is derived from another data source.
Figure 7:
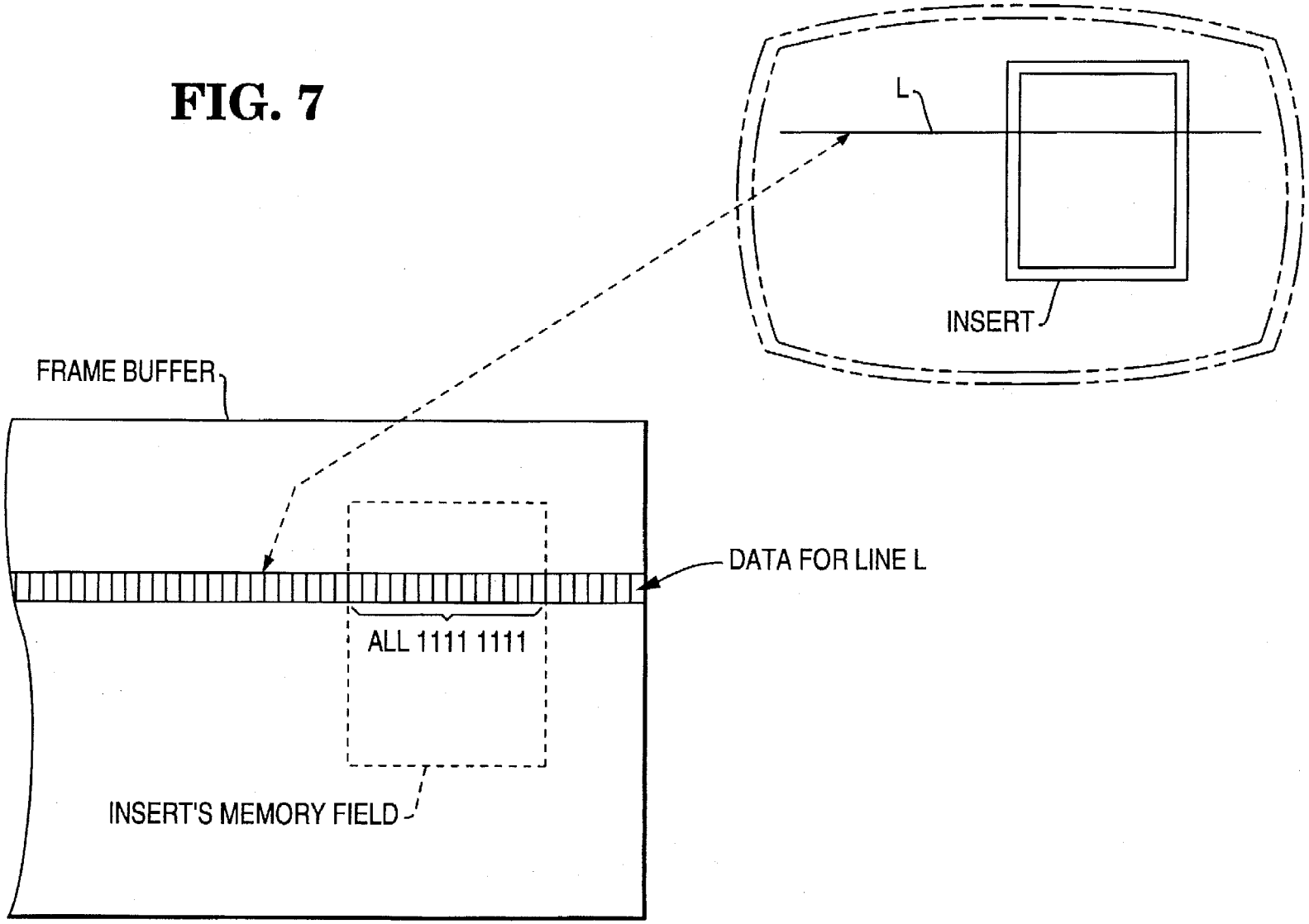
FIG. 7 illustrates how the data field, in the FRAME BUFFER, corresponding to the pixels in the INSERT, can be filled with a single data word.
Figure 8:
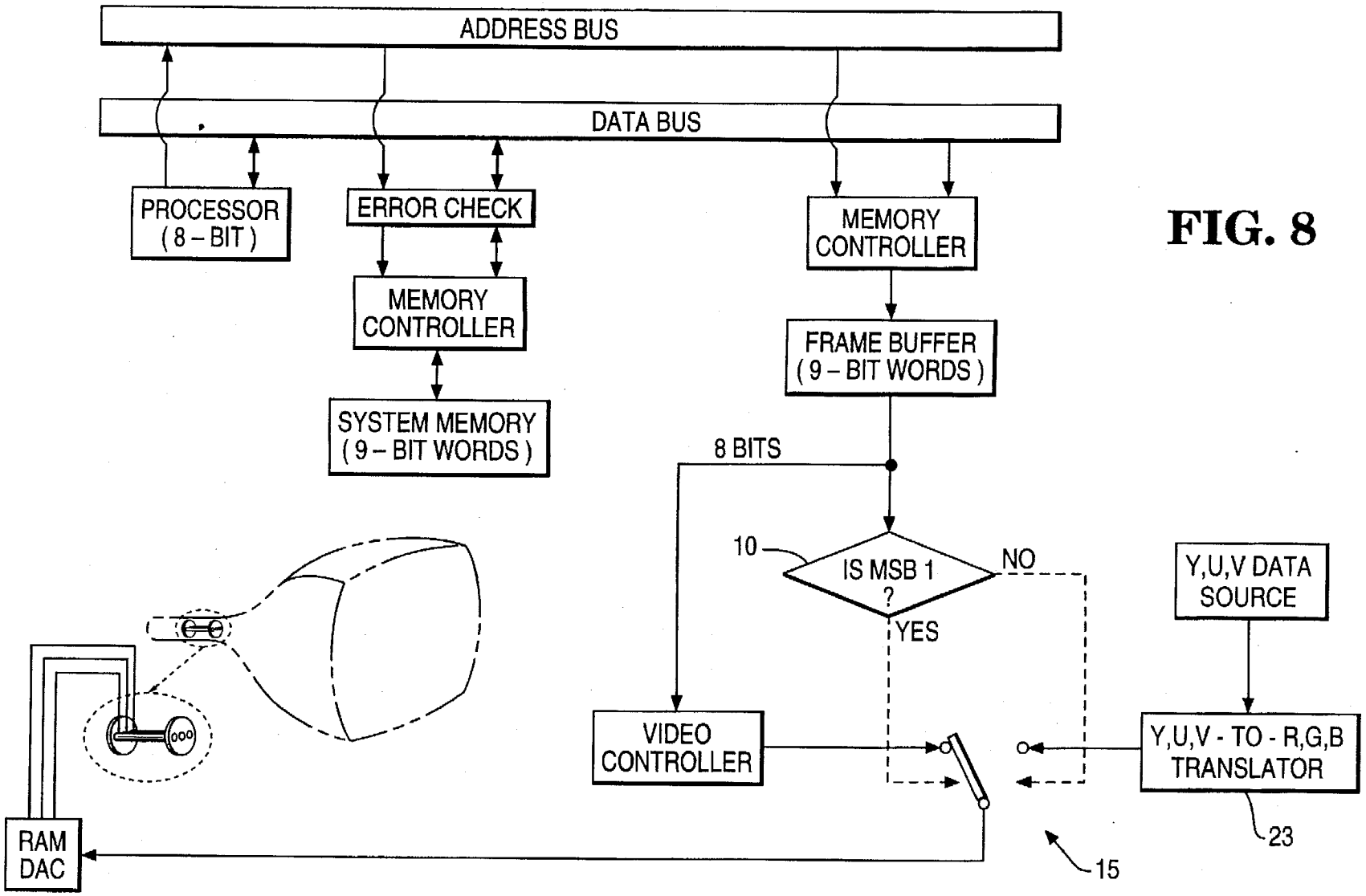
FIG. 8 illustrates one form of the invention.

FIG. 8 illustrates an architecture containing the present invention. The architecture is based on a 9-bit word; SYSTEM MEMORY contains 9-bit words. Most, if not all, data transfers (except to and from the PROCESSOR) utilize 9-bit words.

For example, data transfers from SYSTEM MEMORY to a mass storage device, such as a disc drive or tape drive, use 9-bit words. Data transfers from SYSTEM MEMORY to other computers, such as via a modem or network link, use 9-bit words.

One bit of the 9-bit words is used for error checking, such as by a parity check, by the ERROR CHECK block. The remaining eight bits are used as data.

However, the error checking is transparent to the PROCESSOR. The MEMORY CONTROLLER strips off the ninth bit when delivering data to the PROCESSOR.

Given the architecture just described, a nine-bit FRAME BUFFER can be provided at no significant extra cost. In contrast, if the architecture of FIG. 8 utilized eight-bit words in system memory, it would not be economically feasible to provide nine-bit words in the frame buffer, because significant complications arise. For example, a 9-bit data bus leading to the FRAME BUFFER would be required, while an 8-bit data bus leading to the SYSTEM MEMORY would be required.

With a nine-bit FRAME BUFFER, one bit, such as the MSB, can be used as a control bit, and the remaining eight bits can be used for color information, for the RAM DAC. In operation, a memory location in the FRAME BUFFER is read for each pixel in the CRT. The MSB of the word is examined by block 10.

If the MSB is ONE, a switch 15 delivers the eight bits of color information to the RAM DAC, via path 20. Switch 15 is an eight-bit multiplexer. If the MSB is ZERO, switch 15 delivers data to the RAM DAC from an alternate source which, in this example, is translated YUV data, from block 23.

Each memory location in the FRAME BUFFER corresponds to a pixel on the display. The word, itself in a memory location contains information which determines the data source for the memory location's respective pixel. Restated, each word corresponds to a pixel. Each word selects the data source for the word's pixel.

YUV data has been discussed above. However, the alternate source of data is not limited to YUV data, there are numerous alternate data formats.

The invention can be characterized in the following way. Ordinarily, the switch 15 in FIG. 8 is positioned so that the VIDEO CONTROLLER connects to the RAM DAC. Pixel data is read from the FRAME BUFFER. When the switch 15 detects that the MSB is ZERO, the YUV-to-RGB TRANSLATOR becomes connected to the RAM DAC, and the eight bits of color information associated with the MSB are suppressed. The MSB suppresses use of its data word.

Nine-Bit Frame Buffer Considerations

System memory devices are typically constructed as multiples of eight bits (which constitute one byte), and extra memory is added to provide a ninth bit, used for error checking. This extra memory takes the form of Random Access Memory (RAM), called Parity RAM. The Parity RAM is frequently one bit wide, but other sizes can be used.

The amount of Parity RAM required is computed by multiplying (the number of memory addresses) by (the amount of Parity RAM used for each). For example, if the number of memory addresses is 512, and if each address requires two bytes, then 1024 bits of Parity RAM are required.

System memory is normally designed for compatibility with the bus used by the CPU, and with the system generally. Different busses have different widths, such as 16 bits, 32 bits, 64 bits, etc.

System memory is often parity-protected, and the parity bits are frequently added to each byte in memory. For example:

If the memory stores data in one-byte chunks (ie, the data bytes are eight bits long), then one parity bit is added to each chunk.

If the memory stores data in two-byte chunks (ie, the data words are 16 bits long), then two parity bits are added to each chunk.

For 32-bit words, four parity bits are stored for each.

The graphics frame buffer is normally not parity-protected. However, it is arranged similar to the system memory, in containing words of similar length. Because of the type of organization of the frame buffer, there is normally no dedicated memory location available to provide for a specialized control function such as video window selection.

Consequently, the window selection function may be provided by using dedicated address mapping registers, or a color-keying approach. If additional cost is not an issue, then extra memory may be added to provide a dedicated control plane to select the window.

The present invention provides a clear benefit over this approach. The invention defines an architecture using nine bits, instead of eight. The extra bit is always present, but in graphics applications is nearly always unused.

The inventor has determined that the nine-bit architecture can be used to create enhanced color capability when used in graphics applications. Thus, instead of providing 256 colors, as available from an eight-bit architecture, the invention provides 512 colors.

The ninth bit does provide a mechanism to allow selection of a video or graphics screen. In addition, the ninth bit can be set or reset to allow the window area to be non-rectangular. Defining the window as rectangular is typically done when a register address mapping is used. The fact that the invention provides this bit and makes it individually readable and writeable provides a mechanism which enhances the state of the art.

Numerous substitutions and modifications can be undertaken without departing from the true spirit and scope of the inventive concept as defined in the following claims. What is desired to be secured by Letters Patent is the invention as defined in the following claims.

I claim:

1. In a computer, the improvement comprising:

a) two sources of data for a display;

b) a frame buffer which contains, for each pixel of the display, i) N bits of color information and ii) one bit for selecting a data source; and c) a converter for converting the color information into analog voltages for the display.

2. In a computer, the improvement comprising:

a) system memory which stores nine-bit words at each memory location, one bit of the nine-bit words being used for error checking;

b) a memory controller which performs error checking during selected memory transactions; and c) a video frame buffer which stores nine bits per pixel, one bit of the nine bits per pixel being used for selecting a data source for a display.

3. A video frame buffer for a display in a computer, comprising:

a) multiple memory locations, each of which contains an M -bit word, i) some of which are used for color information for a pixel in the display, and ii) one bit of which is used to suppress use of said color information.

4. In a computer, which includes a display having pixels, the improvement comprising:

a) two data sources for the display;

b) a video frame buffer which contains one memory location for each pixel, such that i) each memory location specifies eight bits of color information for its pixel; and ii) each memory location selects a data source for its pixel.

5. A computer, comprising:

a) a display in which analog voltages are fed to electron guns in a CRT;

b) a system memory which stores nine-bit words, i) eight bits of the nine-bit words of the system memory being used for data, and ii) one bit of the nine-bit words of the system memory being used for error-checking; and c) a frame buffer which stores nine-bit words, i) eight bits of the nine-bit words of the frame buffer being used for video data, and ii) one bit of the nine-bit words of the frame buffer being used for choosing a source for the analog signals.

6. The computer of claim 1, wherein each of the two sources of data for the display provides data to the frame buffer.

* * * * *